United States Patent [19]

Takenaka et al.

[11] Patent Number: 4,792,720

[45] Date of Patent: Dec. 20, 1988

[54] COLOR CATHODE RAY TUBE

[75] Inventors: Shigeo Takenaka; Eiji Kamohara; Takashi Nishimura, all of Fukaya, Japan

[73] Assignee: Kabushiki Kaisha Toshiba, Kawasaki, Japan

[21] Appl. No.: 939,002

[22] Filed: Dec. 8, 1986

[30] Foreign Application Priority Data

Dec. 9, 1985 [JP] Japan ..... 60-274959

[51] Int. Cl.[4] ..... H01J 29/07; H01Q 1/00

[52] U.S. Cl. ..... 313/409; 313/477 R; 313/402; 315/13.1; 340/720

[58] Field of Search ..... 313/402, 408, 409, 413, 313/415, 477 R, 471; 315/10, 13; 358/69; 220/2.1 R, 2.1 A, 2.3 A; 340/720, 703, 717

[56] References Cited

U.S. PATENT DOCUMENTS 2,630,542 3/1953 Goldsmith ..... 313/413
3,071,706 1/1963 Waldorf ..... 313/477 R
4,456,853 6/1984 Robinder et al. ..... 313/421
4,659,957 4/1987 Nill ..... 313/402

*Primary Examiner*—David K. Moore
*Assistant Examiner*—Michael Horabik
*Attorney, Agent, or Firm*—Oblon, Fisher, Spivak, McClelland & Maier

[57] ABSTRACT

A color cathode ray tube with a shadow mask has a screen partitioned into a plurality of elemental screen areas and electron guns positioned and corresponding to the respecting elemental screen areas, the electron guns generating electron beams to scan the screen. The shadow mask includes effective regions having a number of apertures passed through by the electron beams to impinge on the screen and a non-effective region adjacent to the effective regions. Phosphors as a signal source are deposited on the non-effective regions or the boundaries between the elemental screen areas to emit a light signal by electron beam excitation. A photo-electric transducer is provided facing the shadow mask and to detect the light signal for feed back to a deflection system to control the electron beam deflection.

8 Claims, 4 Drawing Sheets

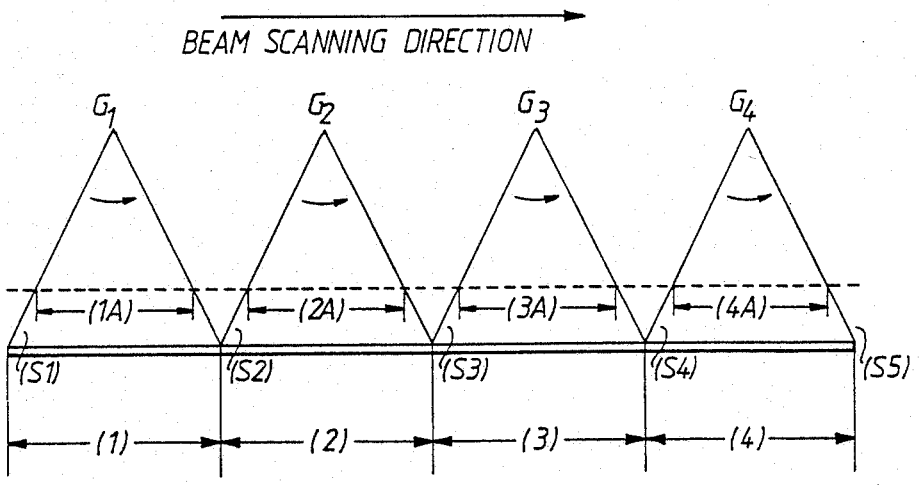
FIG. 5.
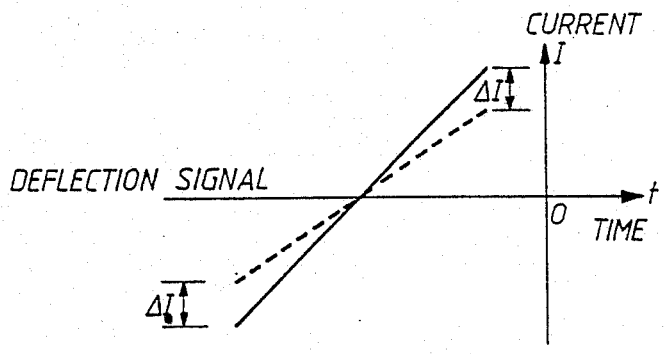
FIG. 6.
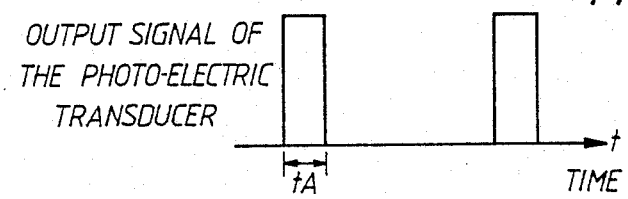

COLOR CATHODE RAY TUBE

BACKGROUND OF THE INVENTION

The invention relates to a color cathode ray tube with a single screen having a plurality of partitioned elemental screen areas, more particularly, to the structure including a signal source for electron beam scanning correction.

Color cathode ray tubes for large-sized, high brightness, high resolution color TV receivers for use in high defininion TV systems, or for large-sized, high resolution graphic display units for use in computer terminals, demand specification requirements differing from those for color cathode ray tubes applicable to general consumer applications. Various investigations have been carried out to try and meet these specification requirements.

Conventional high brightness, high resolution shadow mask color cathode ray tubes, in small-sized tube configurations, are at present commercially available. However, large-sized tubes with sufficiently high degrees of brightness and resolution have yet to be commercially realized. The main reasons for this shortcoming can be attributed to the increase in the magnification factor of the electron-optics of the electron gun which would necessarily accompany any extended tube depth due to possible increases in tube dimensions. There is a reduction in the electron beam energy intensity on the screen surface as a result of any screen enlargement.

A color cathode ray tube which combines several small-sized, high brightness, high resolution color cathode ray tubes to form a single screen has been proposed in Japanese Patent Publication No. 54-12035. The most significant fact resulting from this method was the junction of the reproduced multi-partitioned screen image. The minimum requirement for the joining of the multi-partitioned screen image is the accurate synchronisation of the transmission time of the video signal, corresponding to the respective partition zones at each of the partitioned screen areas, i.e. the time required for a single scanning line ot trace each of the partition zones, and the time at which deflection scanning is initiated of the effective partition screen.

In general, it is possible to accurately synchronise both of these aforementioned time requirements by carrying out adjustments to the tube drive circuitry. However, over extended times periods deviations arise due to inherent ageing of the color cathode ray tube drive circuitry itself. Also deviations such as thermal deformation to the external and internal member of the tube occur even over short time periods immediately after switch-on and for considerable time periods thereafter.

Consequently, in color cathode ray tubes in which time-related deviations are present, with respect to the video signal and deflection scanning, overlapping of the reproduced image occurs between the small partitioned screen areas, together with the appearance of gaps, which give rise to considerable deterioration in the over all quality of the reproduced picture image.

SUMMARY OF THE INVENTION

It is an object of this invention to provide a large-sized color cathode ray tube with long-lasting, high brightness and high resolution together with optimum picture image reproduction quality.

According to this invention, a color cathode ray tube is provided comprising a screen of phosphor formed by a plurality of elemental screen areas, electron gun means positioned facing and corresponding to the respective elemental screen areas and a shadow mask assembly positioned facing the screen. The electron gun means has a plurality of elemental electron guns to generate electron beams. The shadow mask assembly has elemental effective regions facint and corresponding to the elemental screen areas respectively, the effective regions having a number of apertures passed through by the electron beams. The shadow mask assembly also has at least one non-effective region adjacent the elemental effective regions.

At least one signal source is arranged on or close to the non-effective region of the shadow mask assembly to generate a signal by the electron beam impingement on the signal source.

Signal receiving means is positioned facing the shadow mask assembly to detect the signal from the signal source. As the signal source, phosphor may be deposited on the non-effective region. The phosphor emitting light signal is casued by electron beam impingement. As the signal receiving means, a photo-electric transducer may be used to detect the light signal.

BRIEF DESCRIPTION OF THE DRAWINGS

FIG. 5 is a diagram explaining the operating principle of the color cathode ray tube of FIG. 1, FIG. 6 is a diagram of the compensated deflection signal and output signal of the photo-electric transducer of the invention.

DETAILED DESCRIPTION OF THE PREFERRED EMBODIMENT

Referring now to FIGS. 1 to 6, a color cathode ray tube of an embodiment of this invention is illustrated.

Figure 1:
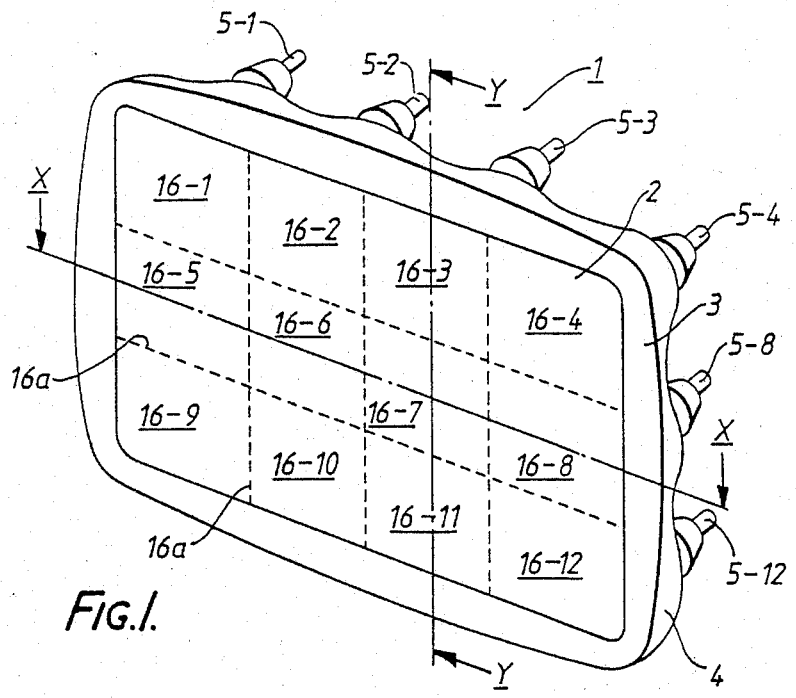
FIG. 1 is a schematic perspective view showing an embodiment of the invention.
Figure 2:
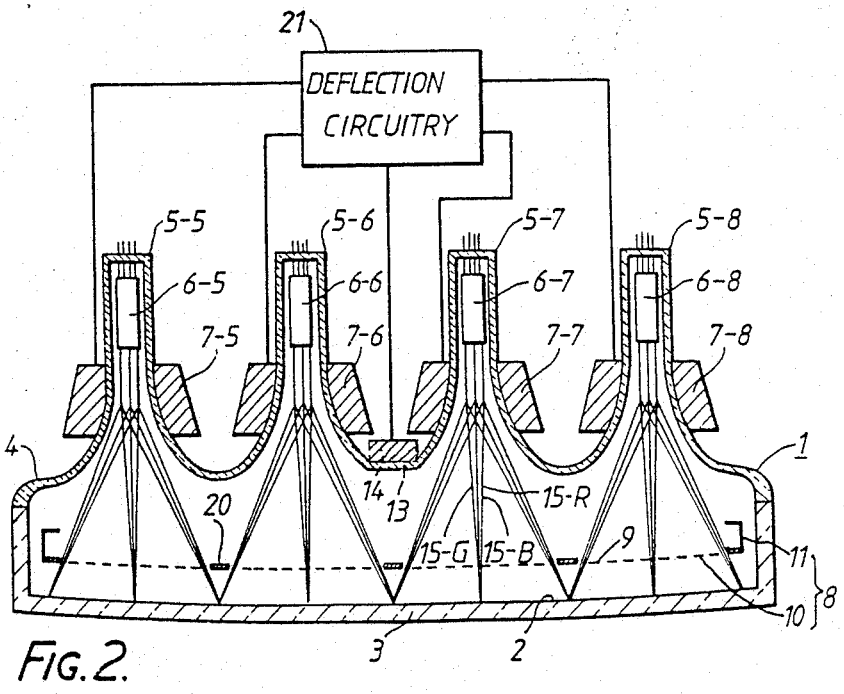
FIG. 2 is a cross-sectional view taken along X—X line of FIG. 1.
Figure 3:
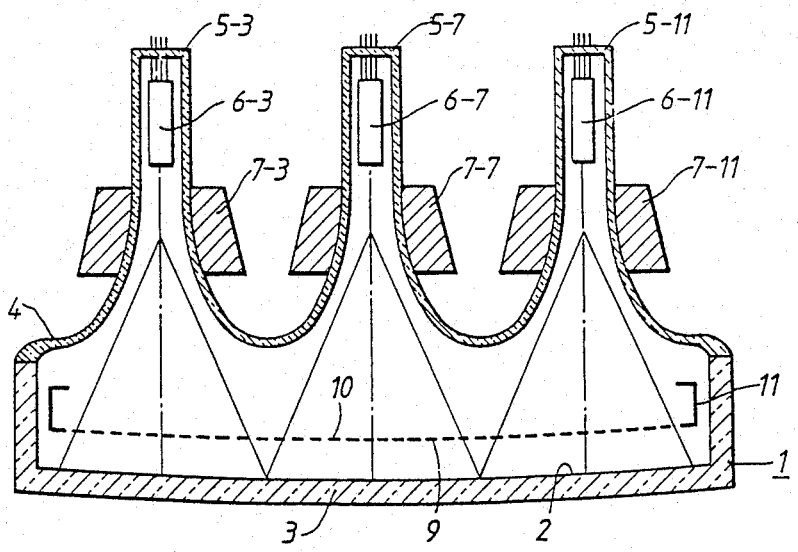
FIG. 3 is a cross-sectional view taken along Y—Y line of FIG. 1.

In FIGS. 1, 2 and 3 a color cathode ray tube 1 comprises an evacuated envelope which has a transparent panel 3 fitted with a screen 2 on its inner surface, twelve neck portions 5-1 to 5-12 which are continuous with panel 3 and funnel 4, twelve elemental electron guns 6-1 to 6-12 built into respective neck portions 5-1 to 5-12. Twelve externally mounted deflection yokes 7-1 to 7-12 extend from each of the nexk portions to funnel 4. A shadow mask assembly 8 contains a shadow mask 10 with a number of apertures 9 symmetrically located at predetermined space on screen 2, and a mask frame 11 supporting mask 10.

Screen 2 is made of an aluminum backed phosphor layer which primary color phosphor stripes are arranged on the inner surface of screen 2. Funnel 4 is provided with a transparent window 13 to receive light. A signal receiving means, i.e. a photo-electric transducer 14 as a photo diode is positioned outside transparent window 13 facing mask 8. Photo-electric transducer 14 is connected to a deflection circuitry 21.

Each of elemental electron guns 6-1 to 6-12 comprises three electron guns generating the three electron beams 15-R, 15-G, and 15-B to excite screen 2 for emitting red, green, and blue. These beams are converged on screen 2 and are deflected to scan certain predetermined areas of screen 2 in response to each of the video input signals. As the photo-electric transducer 14 a photo-conductive element, e.g. CdSe element and a photo-multiplier may be used, besides a photo diode.

The position of funnel window 13 to which the photo-electric transducer 14 is attached is positioned so as to be located at a position from and corresponding to the center of the shadow mask and the screen. In order to clearly detect the light from signal source 20 disposed on mask 10, photo-electric transducers may be set as a plurality of the positions of funnel 4. There may be the funnel positions between neck portions 5-1 to 5-12.

Each of electron beams, which reaches to shadow mask 10 at predetermined angles, is selected by means of apertures 9 in shadow mask 10, whereby the electron impingement causes certain of the phosphors on screen 2 to fluoresce.

The whole of screen area 2, is divided up into partitioned elemental screen areas 16-1 to 16-12, each of the respective partitions of which are beam-scanned by means of the respective electron guns. In this embodiment there is a total of 12 partitioned elemental screen areas, i.e. three elemental areas in the vertical direction, and four elemental areas in the horizontal direction.

Figure 4:
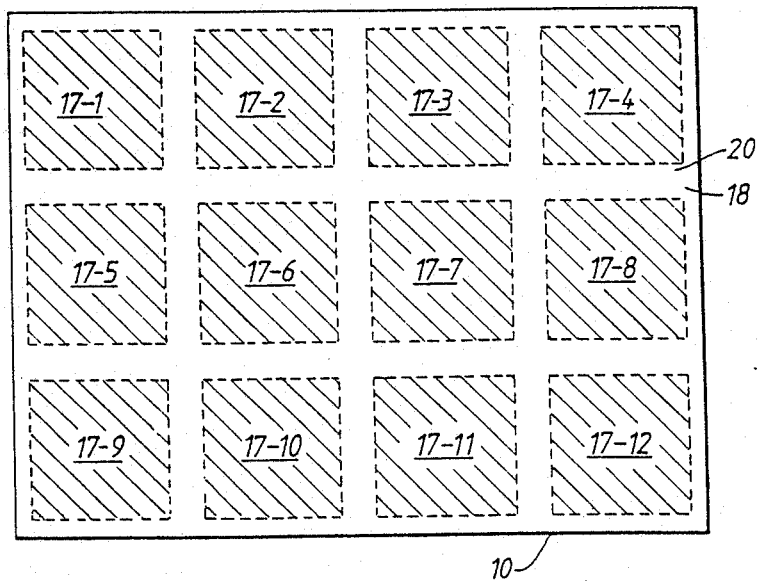
FIG. 4 is a flat plan view illustrating the structure of the shadow mask assembly of the invention.

FIG. 4 shows the shadow mask 10 contains numerous fine apertures distributed over its entire surface, the area of which is sub-divided into 12 partitioned elemental regions, each of which is related to and covered by one of the 12 elemental electron guns.

In FIGS. 2 and 4, shadow mask 10 is divided into effective regions 17-1 through 17-12 with a number of apertures 9 which perform the function of color selection electrodes, and non-effective regions 18 which have no color selection function. Non-effective regions 18 are coated with phosphors as signal sources 20 which emit light of wavelengths differing from those of screen 2.

It is desirable that the signal sources may be of a phosphor with a luminescence spectrum having peaks in the ultraviolet range which a photo-electric transducer can easily detect. $Ca_2MgSiO_7$:Ce phosphor is used, which has 3940 Å peak and 10% persistence is 0.12 μs less than the persistence (more than 10 μs) of the screen phosphors.

FIG. 5 illustrates the four horizontally oriented partitions across the screen area for the principle of operation of the embodiment. In order to simplify explanation by means of FIG. 5, the three original electron beams will be regarded as a single group of beams.

In conventional single electron gun type color cathode ray tubes, horizontal scanning was facilitated by deflecting a single group of electron beams, generated from a single electron gun, from position S1 to position S5.

In the embodiment of the invention, the screen is divided between position S1 and position S5 to form elemental screen areas (1), (2), (3) and (4). Four successive horizontal scanning operations are performed to cover the entire system by means of respective electron beam groups G1, G2, G3 and G4 of elemental electron guns and their corresponding deflection systems, located at various predetermined positions. The respective effective regions have widths (1A), (2A), (3A) and (4A) less than that of elemental screen areas. There are signal sources of phosphor on the boundaries of the effective regions. Further, reproduciton of the whole picture image is built up by repeated horizontal scanning of the screen. The most important factor in this system, which is clear from FIG. 1, is the joining of the images at each of the junctions **16*a*** at the elemental screen areas. In conventional color cathode ray tube systems with no partitioned screen, the raster size for the total picture image had no effect on quality-related parameters such as image continuity or reproductivity during picture image reproduction.

It is clear from FIG. 1, however, that, in the embodiment, the size of the raster for each of the elemental screen areas is an important factor in determining the quality of the junctions at each of the partition picture images.

The system used in the embodiment accurately allocates the video signal, for each horizontal scan sequence, into four separate time divisions. The itme sharing is allocated to t1, t2, t3 and t4 for each of the areas (1) through (4) shown in FIG. 5, and the video signal is applied to the electron beam source G1 from the moment time, $t=0$, to the moment time $t=t1$, regardless of deflection scanning. Following this, the video signal, again regardless of deflection scanning, is applied to electron beam source G2 between time period $t=t1$ and $t=t1+t2$. The video signal is then sequentially applied to each of the electron beam sources in a similar manner.

Also, the electron beam is deflected precisely for each of the elemental screen areas by synchronising the signal applied to each of the deflection systems with the partitioned video signal. Here, the condition which initiates continuous correction of the reproduced image across the total screen area, is the synchronisation of hte time at which the video signal, corresponding to the elemental screen area, is applied and the time required to precisely facilitate a single horizontal scanning sequence in each of the partitioned elemental screen areas.

In more details, assuming that the times required to facilitate a single horizontal scan from each of elemental screen areas (1) through (4), in FIG. 5, are allocated to td1, td2, td3 and td4, then timing requirements are $t1=td1$, $t2=td2$, $t3=td3$ and $t4=td4$.

Also, in a manner similar to that described above, the conditions of the video signal for the vertical direction and the deflection signal depend on the synchronisation of the time at which the video signal, corresponding to the elemental screen area in the vertical direction, is applied and the time required to precisely initiate a single horizontal scan in each of the elemental screen area.

Within the constraints of the conditions mentioned above, it is in an easy manner to precisely partition the video signal in accordance with each of the elemental screen areas and operate the system without the needed concern about circuit-related problems or long time-period related corrections.

Taking into consideration yoke deflection and inherent system circuit ageing, however, it is not an easy matter to synchronise the video signal with the deflection system or to generate a continuous raster of constant size in each of the elemental screen areas. Here, in this embodiment, in addition to coating the non-effective area 18 of shadow mask 10 with phosphors as a signal source 20 for the purpose of detecting and correcting the position of the electron beam on the screen surface, a photo-electric transducer 14 shown in FIG. 2 is provided. The transducer optically responds to the light emitted from the phosphors. In the system, prior to initiating actual reproduction of the picture image, sequential raster scanning is initiated for each of the areas and correction of the size of each of the area rasters is facilitated.

FIG. 6 shows both the deflection signal at the moment of correction and the output signal of the photo-electric transducer. The correction system initially amplifies only that current component in which the horizontal or vertical signal shown by the dashed line in FIG. 6, under normal operation conditions, corresponds to the ΔI component of FIG. 6, then slightly increases the amount of deflection at the screen surface. The deflected electron beam, under these conditions, cause the phosphors disposed on non-effective area 18 of FIG. 4, to emit light.

The time, tA, during which light is emitted, is the time corresponding to the amplitude component of the deflection signal. In the case of a normal size-raster being produced with the deflection system operating under normal conditions, this time is always constant. Here, in the event of the size of the raster on the screen changing due to variations in the deflection system characteristics, the time at which the output signal of the photo-electric transducer 14 in FIG. 2 is output varies by the amount corresponding to the shift in the size of the screen raster. Hence, it is always possible to generate the required raster on the screen by feeding back, to the deflection circuitry 21, the Δt component of the photo-electric transducer signal output time, $tA+\Delta t$ (Where Δt is the varying component due to the shift) as the amount corresponding to the shift of the deflection system, thereby facilitating correction of the deflection signal.

By carrying out raster size correction for each of the individual partition zones and initiating video signal synchronisation, by means of the procedures, it is possible to consistently facilitate high quality picture image reproduction over the entire screen surface.

In the embodiment of the invention, in order to carry out equivalence measurements on the size of the raster of each of the elemental screen areas on the screen, by means of the output signal of the photo-electric transducer, the current component corresonding to the ΔI component, as illustrated in FIG. 6, is pre-amplified in the vertical of horizontal deflection signal. Thereby the amount of defelction for each of the elemental screen areas is widened. Here, in the event of over-driving the system with an excessive amount of deflection during an actual image tracing operation, it is possible to facilitate correction in a manner similar to that mentioned above, by extending the time that the video signal is applied to each of the electron beam sources in FIG. 5, without pre-amplification of the aforementioned ΔI current component in the deflection signal.

The invention may be applied to color cathode ray tubes in which the frame has the complementary role of reinforcing the shadow mask on the non-effective regions, as was proposed in Japanese Patent Application No. 60-97901 by this applicant.

The invention may be readily applied to systems where a single electron beam, emitted from the electron gun, is in actual fact, turned into a plurality of separate electron beams by deflection the beam in plural steps, as proposed in Japanese Patent Application Nos. 60-82567 and 60-82568 by this applicant.

Further, in the invention, signal source phosphors, i.e. deflection signal correction phosphors are deposited or coated over the entire non-effective regions of the shadow mask, which enables the same degree of correction as though only part of the non-effective region is coated. Also, the effective regions of the shadow mask may be either partially or entirely phosphor coated. In this case, amplification of the deflection signal's ΔI current component, as shown in FIG. 6, was found to be unnecessary for deflection signal correction. Also, since the coating of signal source phosphors around the central region of the effective part of the shadow mask had no significance, due to the correction accuracy in the central region being reduced, coating the phosphors in the neighborhood of the partitioned elemental screen area boundaries was found to yield better results.

The phosphors as the signal source for deflection signal correction in the embodiment should all be of the same type. In the case of correcting several areas at the same time, more than two different types of phosphors could be used to be deposited on the shadow mask 10. In this case, phosphors which have different luminescence spectra or different emitted light intensities, could be used.

Also, with respect to the photo-electric transducer, it should be noted that the optimum quality and type of transducer should be selected in accordance with the applied correction method: factors determining optimum device selection are increased light emitting sensitivity, utilisation of various types of phosphors, and improved correction systems.

The embodiment of the invention is described with respect to actual operating conditions under NTSC signal conditions. The system may be readily made applicable to the storage of a single picture image or the picture image information for a single line in system frame memory of line memory, in the event of simultaneous screen scanning of several partition picture images.

Figure 7:
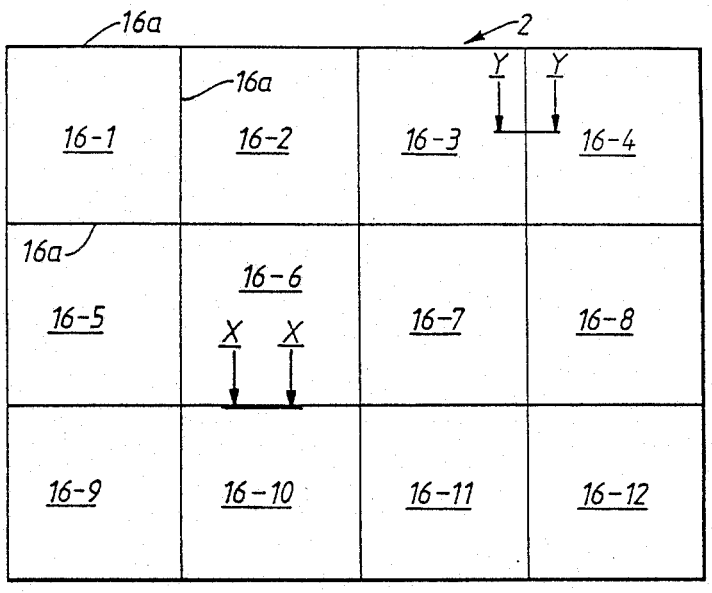
FIG. 7 is a plan view explaining another embodiment of the invention.
Figure 8:
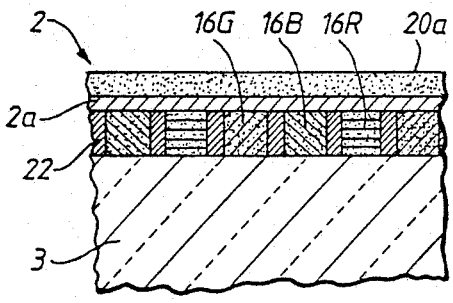
FIG. 8 is an enlarged partial cross-sectional view taken along X—X line of FIG. 7
Figure 9:
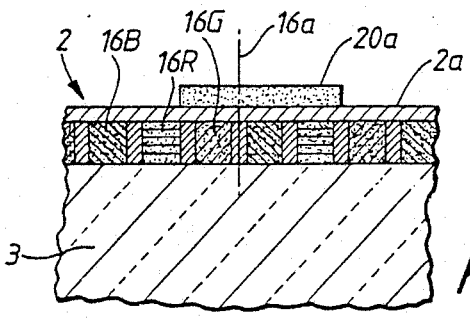
FIG. 9 is an enlarged partial cross-sectional view taken along Y—Y line of FIG. 7.

Another embodiment of this invention is shown in FIGS. 7 through 9, wherein like reference numerals designate identical corresponding parts in the embodiment aforementioned.

Phosphors 20*a* for a signal source are coated on the boundaries of partitioned elemental screen areas 16-1 through 16-12. In more details, the screen 2 is deposited on a transparent panel 3 of glass. Screen 2 is of phosphor stripes 16G, 16B and 16R emitting respective green, blue and red lights. Further, light absorbing stripes 22 are interposed between respective color emitting phosphors. Screen 2 also has a metal backed layer 2*a* of aluminum thereon. On metal backed layer 2*a*, phosphors 20*a* emitting index signals for deflection control are coated in a stripe shape. Phosphors 20*a* may be $Ca_2MgSiO_7$:Ce above mentioned. In the tube operation, when electron beams scan screen 2 and reach at boundaries 16*a* of elemental screen areas, phosphors 20*a* emit light which is detected received by a photo-electric transducer. The received index signal is transmitted from the transducer to the deflection circuitry to control its beam deflection.

Alternatively, the phosphors as a signal source may be disposed on both of non-effective areas and the boundaries 16*a* of the screen 2 in order to more accurately control the beam deflection.

According to the invention, the utilisation of a phosphor coated on the shadow mask as a signal source for detecting the beam position makes possible the continuous reproduction of the picture image on the screen without the appearance of partition junctions be making correction for any junction misalignment at the boundaries of the partitioned elemental screen picture image. As a result, it is possible to obtain a color cathode ray tube having a large-sized screen without the appearance of partition junctions, thereby providing superior viewing with increased brightness, higher resolution, and improved picture reproduction quality, all in a system which has a shorter neck depth compared with that of conventional systems.

We claim:

1. In a color cathode ray tube with a single screen containing a plurality of elemental screen areas, comprising:

a screen provided with a plurality of phosphors emitting colors, said screen being formed by a plurality of elemental screen areas;

electron gun means positioned facing and corresponding to said respective elemental screen areas, said electron gun means having a plurality of elemental electron gun for generating a plurality of electron beams for successively scanning each respective elemental screen area corresponding thereto;

a shadow mask assembly positioned facing said screen, said shadow mask assembly including elemental effective regions facing and corresponding to said elemental screen areas, said elemental effective regions having a number of apertures through which said electron beams pass and at least one non-effective region adjacent said elemental effective regions;

at least one signal source arranged on or close to said non-effective region or boundaries of said elemental screen areas to generate a predetermined signal by an impingement of said electron beams on said source; and signal receiving means positioned facing said shadow mask assembly to detect said signal from said signal source, wherein the operation of said scanning is based on the detected signal controlling each successive horizontal scanning operation of said plural elemental electron guns, wherein when an electron beam emitted from one of said electron beams impinges on said signal source, said signal generated by said signal source is detected by said signal receiving means, the scanning operation of the electron beam of said one elemental electron gun is stopped, and the scanning operation of another of said plural elemental electron guns is triggered and said another elemental electron gun scans the elemental screen area corresponding to said another elemental electron gun.

2. The color cathode ray tube of claim 1, wherein said signal source is disposed on said non-effective region of said mask assembly to emit light by electron beam.

3. The color cathode ray tube of claim 1, wherein said signal source includes phosphor.

4. The color cathode ray tube of claim 3, wherein said signal source is disposed along on at least a part of said non-effective region.

5. The color cathode ray tube of claim 1, wherein said signal source is disposed on boundaries of said elemental screen areas.

6. The color cathode ray tube of claim 1, wherein said signal source is disposed on said non-effective areas of said shadow mask and said boundaries of said elemental screen areas.

7. The color cathode ray tube of claim 1, wherein said color cathode ray tube further comprises an evacuated envelope having a panel disposed with said screen thereon, a funnel and a plurality of neck portions extended from said funnel, and each of said elemental electron guns is positioned within said neck portions respectively, and signal receiving means is positioned outside said funnel.

8. The color cathode ray tube of claim 1, wherein said signal receiving means comprises a photo-electric transducer.

* * * * *